United States Patent [19]

Smarsly et al.

[11] Patent Number: 5,032,353

[45] Date of Patent: Jul. 16, 1991

[54] SINTERING METHOD FOR PRODUCING STRUCTURAL COMPONENTS OF AN INTERMETALLIC COMPOUND

[75] Inventors: Wilfried Smarsly, Munich; Raimund Lackermeier, Goldach, both of Fed. Rep. of Germany

[73] Assignee: MTU Motoren-Und Turbinen-Union Muenchen GmbH, Munich, Fed. Rep. of Germany

[21] Appl. No.: 604,790

[22] Filed: Oct. 26, 1990

[30] Foreign Application Priority Data

Oct. 27, 1989 [DE] Fed. Rep. of Germany ..... 3935955

[51] Int. Cl.[5] ..... B22F 3/24

[52] U.S. Cl. ..... 419/12; 419/17; 419/19; 419/26; 419/28; 419/29; 419/32; 419/49; 419/55

[58] Field of Search ..... 419/12, 17, 19, 26, 419/28, 29, 32, 49, 55

[56] References Cited

FOREIGN PATENT DOCUMENTS 8604840 8/1986 European Pat. Off. .

*Primary Examiner*—Stephen J. Lechert, Jr.
*Attorney, Agent, or Firm*—W. G. Fasse

[57] ABSTRACT

Structural components of at least one intermetallc compound and having complicated contours, are made by the steps of preparing a powder mixture of elemental metal powders including at least one powder of a low melting metal element or component and one powder of a high melting metal element or component that subsequently are to form the intermetallic compound. The powder mixture is then sintered to form a sintered body which is machined to a contour close to the finished contour and to dimensions close to the final dimensions. The so machined and shaped part is enveloped with an envelope of the high melting metal element or component. The enveloped part is subjected to a hot isostatic reaction pressing whereby the intermetallic compound is formed.

17 Claims, No Drawings

SINTERING METHOD FOR PRODUCING STRUCTURAL COMPONENTS OF AN INTERMETALLIC COMPOUND

FIELD OF THE INVENTION

The invention relates to a method for sintering metal structural components having complicated final contours and made of intermetallic compounds including at least one low melting and one high melting metal element.

BACKGROUND INFORMATION

A method of the type described above is disclosed in International Patent Publication Wo 86/04840 describing a process that has the disadvantage that the sinter powder comprises hard intermetallic particles, so that it is necessary to intermix a binding agent with the sintering powder for obtaining a sintered shape as close as possible to the final desired contour. Such binding agents include waxes, thermosetting materials, or thermoplastic materials, all of which have the disadvantage that they cause a large shrinking of 10 to 20% by volume. Furthermore it is not possible to machine the green body to form the final contour with a high machining precision.

OBJECTS OF THE INVENTION

In view of the foregoing it is the aim of the invention to achieve the following objects singly or in combination:

to improve a sintering method for manufacturing structural components in such a way that binding materials are not required;

to minimize the degree of shrinking, so that an intermediate machining step can produce contours and dimensions close to the desired contours and final dimensions; and to provide a method which permits machining a presintered blank as close as possible to the desired final contour or dimensions, at a time within the manufacturing sequence when the sintered blank is easy to machine so that costs are reduced.

SUMMARY OF THE INVENTION

The above objects have been achieved according to the invention by the combination of the following steps:

(a) sintering a powder mixture of elemental metals which are to form the intermetallic compound, at temperatures within a range of 75 to 100% below the melting point of that metal in the powder mixture which has the lowest melting temperature to form an intermediate or compact sintered body having a density of at least 95% of the theoretical density of the metals or rather of the sintered body;

(b) machining the so sintered body into a structural component or shaped part having contours as close as possible to the final desired contours and dimensions close to required final dimensions;

(c) enveloping the so formed structural component or shaped part with the high melting metal of the intermetallic compound yet to be formed; and (d) subjecting the presintered, machined, and enveloped structural component to a hot isostatic reaction pressing at the reaction temperature for the formation of the intermetallic compound.

With the method according to the invention, advantage is taken of the machinability of the metallic components at a time in the manufacturing sequence when these components have not yet reacted to form a hard, difficult to machine intermetallic compound. Preferably, the sintered blank or semi-finished product is formed by sintering a powder mixture of the metallic components which after the sintering will form the intermetallic compound. For this purpose a matrix is formed that can be machined in a chip removing manner or any other suitable way. The matrix is formed of the metal component having the lowest melting point into which the higher melting components are embedded in the form of powder particles having dimensions within the range of 0.2 to 15 μm. As a result, it becomes possible to advantageously use any available machining processes for the formation of the structural component of intermetallic compounds yet to be formed. All the machining processes that could be applied heretofore to the metallic components individually, can be applied according to the invention to the sintered body in which the intermetallic compound has not yet been formed.

The enveloping of the machined intermediate structural component in the high melting component has the advantage that for the subsequent hot isostatic reaction pressing it is not necessary to use a compact pressing mold so that even complicated final contours can be subjected to the hot isostatic pressing and so that the volume shrinking during the formation of the intermetallic compound can be performed free of any diffusion pores.

According to a preferred embodiment of the present method, up to 50% by weight of the total weight of the powder mixture, of a powder of the intermetallic compound, may be intermixed with the powder of the elemental metals. This feature has the advantage that on the one hand the machining possibilities are not substantially limited and that on the other hand a higher material strength of the compact sintered body is achieved. Further, this intermixing provides the reaction nuclei for the formation of the intermetallic compound during the subsequent hot isostatic pressing.

A preferred range for the addition of the powder of the intermetallic compound to be formed is within the range of 2 to 30% by weight of the total powder mixture weight. It has been found that within this range the durations for the subsequent hot isostatic reaction pressing can be substantially reduced.

In addition to introducing intermetallic compounds in powder form into the powder mixture for the purpose of providing reaction nuclei or for reducing the durations required for the hot isostatic reaction pressing, other additives up to 30% by weight of the total powder weight may be introduced for the purpose of other improvements such as the creeping resistance, and/or the oxidation resistance, and/or the corrosion resistance of the structural component to be formed. These further additives are in the form of ceramic particles having grain sizes smaller than 1μ or they are in the form of ceramic short fibers. These further quality improving additives are preferably selected from ceramic additives, such as $Al_2O_3$, $Er_2O_3$, TiC, or $TiB_2$.

In order to avoid gas inclusions in the compact sintered body, the preliminary sintering is preferably performed in an evacuable recipient. It is preferred to avoid gas inclusions or gas filled pores because they impair the thin envelope during the subsequent hot isostatic reaction sintering or pressing.

The intermediate machining operation between the preliminary sintering and the final hot isostatic reaction sintering to achieve a configuration of the structural component as close as possible to the final configuration, is preferably performed by means of chip removal or by electrochemical machining. These machining operations can be advantageously used because the compact sintered body is not yet made of the intermetallic compound that will be formed in the subsequent hot isostatic reaction sintering. As a result, the useful life of the machining tools is prolonged, which is advantageous for reducing costs. In connection with electrochemical machining, the durations required for this operation are shortened, which also reduces costs.

The hot isostatic reaction pressing should advantageously be performed without any mold and merely under the influence of a pressurized gas. In order to assure a uniform pressure transmission onto the machined surfaces of the preliminarily sintered body having a contour close to its final contour, it is preferred that the above mentioned envelope has a uniform thickness throughout the surface of the sintered body. The thickness of the envelope should be within the range of 0.05 to 1.0 mm, preferably within the range of 0.1 to 0.5 mm. The envelope of the high melting component of the intermetallic compound to be formed, is preferably applied inside an evacuable recipient by means of vapor deposition, sputtering, or plasma spraying.

A relative thin envelope has the advantage that it does not substantially change the machined contour which is close to the final contour of the structural component. Taking the envelope and the volume shrinkage into account, the reaction sintering then produces a structural component of intermetallic compounds having the desired final contour or dimensions. The use of the high melting component of the intermetallic compound for forming the envelope has the advantage that the reaction sintering of the envelope forming material reacts with the preformed component in the contact surface, namely at the interface between the envelope and the preformed or blank component. As a result of this reaction an intimate intermeshing or bonding between the envelope and the blank is assured, so that the envelope material simultaneously forms a solidly bonded surface improvement of the structural component. The envelope thicknesses at the higher end of the above stated range of up to 1 mm become necessary, for example, if the surface must be lapped or polished subsequent to the hot isostatic reaction pressing or sintering.

Applying the envelope in an evacuated recipient has the advantage that it prevents the inclusion of gas bubbles under the envelope. Such inclusions are undesirable because they would form during the following hot isostatic reaction pressing a bubbling or a partial bursting of the envelope. This is avoided by the application of the envelope under vacuum.

The thicker envelope thicknesses up to 1 mm is preferably applied by means of plasma spraying, especially where complicated final contours of the structural component must be enveloped. Plasma spraying is more efficient in this respect than vapor deposition or sputtering.

The hot isostatic reaction pressing is performed depending on the type of intermetallic compound to be formed in a pressure range between 100 MPa to 300 MPa. Preferably, an inert gas atmosphere, such as an argon atmosphere, is advantageously maintained in the recipient during the hot isostatic reaction pressing. If the pressures are too low, there is the danger that the relatively thin envelope does not withstand the vapor pressure of the low melting components of the intermetallic compounds.

DETAILED DESCRIPTION OF PREFERRED EXAMPLE EMBODIMENTS AND OF THE BEST MODE OF THE INVENTION

Example 1

First a powder mixture is prepared of a titanium powder and of an aluminum powder with a 50 mol % ratio of titanium and 50 mol % of aluminum. The titanium powder has particles smaller than 30 μm and the aluminum powder has particles smaller than 50 μm. The mixing of the powder components is continued until a homogeneous distribution of the titanium and aluminum particles is achieved throughout the volume of the powder mixture. The so prepared powder mixture is placed into a sintering mold to form a Ti/Al blank having, for example, a cuboid shape. The sintering takes place at a temperature corresponding to 75% of the melting temperature of aluminum. The sintering also takes place in a vacuum. The so formed cuboid blank is brought into a configuration close to its final configuration by a machining operation, such as forging, chip removal, and/or electrochemical drilling. The result of these intermediate machining operations is, for example, a turbine blade having a blade root and cooling air channels with dimensions close to the final dimensions. The cooling air channels are filled with quartz rods and then the so prepared structural component, in the form of a still intermediate product, is enveloped by a titanium envelope having a thickness of 0.5 mm. The enveloping is performed by plasma spraying in a recipient which has been previously evacuated. Following the plasma spraying the enveloped structural component or intermediate product is subjected to a hot isostatic reaction sintering and pressing at a temperature of 1300° C. for three hours under a pressure of 200 MPa. During the hot isostatic reaction sintering the structural component shrinks to its final dimensions. Upon completion of the reaction sintering the shrunk structural component now made of an intermetallic compound of TiAl is removed from the high pressure mold and the quartz rods are removed by an etching operation with the aid of hydrofluoric acid.

Example 2

A powder mixture having grain sizes smaller than 30 μm is prepared to contain 25 mol % of titanium particles and 75 mol % of aluminum particles or powder. A powder of an intermetallic phase of $TiAl_3$ is intermixed with the previously prepared aluminum titanium powder mixture. The intermetallic phase powder is added to the extent of 5% by weight of the powder mixture. The intermettalic powder phase has grain sizes smaller than 1 μm. Thereafter, the steps described above in Example 1 are performed, except that the hot isostatic reaction pressing takes place at 1250° C. for 2 hours under the same pressure of 200 MPa as in Example 1. Upon completion of the hot isostatic pressing, the structural component is now made of an intermetallic compound $TiAl_3$ which is removed from the high pressure mold.

Example 3

First a powder mixture comprising the following components is prepared:

21% by weight of aluminum powder having a grain size smaller than 30 μm,

5% by weight of $Al_3Ti$ having a grain size smaller than 1 μm,

25% by weight of $Al_2O_3$ having a grain size smaller than 1 μm, and the remainder being titanium powder with a grain size smaller than 30 μm.

The small deviation of the stoichiometric ratio between the aluminum and the titanium in this example assures that the structural component has a better ductility subsequent to the hot isostatic reaction pressing as compared to components according to the first two examples. The addition of a ceramic component in the form of an $Al_2O_3$ powder having a grain size smaller than 1 μm increase the creeping resistance of the structural component at high operational temperatures. Following the production of the powder mixture as set forth above, the further steps are performed as described in Example 2, whereby a structural component is formed in which the ceramic particle component provides a dispersion hardened structure having a higher creeping resistance on the basis of the intermetallic compound TiAl formed by the hot isostatic pressing in the high pressure mold from which the component is then removed.

Although the invention has been described with reference to specific example embodiments it will be appreciated that it is intended to cover all modifications within the scope of the appended claims.

What we claim is:

1. A method for producing sintered structural components made of at least one intermetallic compound and having required contours and final dimensions, comprising the following steps:

(a) preparing a powder mixture of a first powder of at least one low melting metal element and of a second powder of at least one high melting metal element, (b) sintering said powder mixture at a temperature of 75% to 100% of the lowest melting temperature of said low melting metal element to form a sintered body having a density of at least 95% of a theoretical density of said sintered body, whereby said intermetallic compound is not yet formed, (c) machining said sintered body into a shaped part having contours close to said required contours and dimensions close to said final dimensions, (d) enveloping said shaped part with metal of said high melting metal element of said intermetallic compound yet to be formed, to form an enveloped shaped part, and (e) performing a hot isostatic reaction pressing on said enveloped shaped part at a reaction temperature required for the formation of said intermetallic compound.

2. The method of claim 1, further comprising intermixing with said powder mixture of said metal elements, a third powder of said intermetallic compound, said third powder being within the range of about 1% by weight to about 50% by weight of the total powder mixture weight.

3. The method of claim 2, wherein said third powder is within the range of 2 wt % to 30 wt % of said total powder mixture weight.

4. The method of claim 2, further comprising intermixing with said powder mixture of said first, second and third powders, a fourth ceramic powder within the range of 1 wt % to 30 wt % of said powder mixture.

5. The method of claim 4, wherein said ceramic powder is selected from the group consisting of $Al_2O_3$, $Er_2O_3$, TiC, and $TiB_2$.

6. The method of claim 1, wherein said sintering step (b) is performed so as to form a blank or a semifinished product.

7. The method of claim 1, wherein said sintering step (b) is performed in an evacuated recipient.

8. The method of claim 7, wherein said recipient holds a vacuum smaller than $10^{-3}$ mb.

9. The method of claim 1, wherein said machining step (c) is performed by removing chips from said compact sintered body.

10. The method of claim 1, wherein said step (c) is performed by an electrochemical machining operation.

11. The method of claim 1, wherein said step (d) is performed in an evacuated recipient, holding a vacuum smaller than $10^{-3}$ mb.

12. The method of claim 1, wherein said step (d) is performed as one of the following: vapor deposition, sputtering, and plasma spraying.

13. The method of claim 1, wherein said step (d) is performed to form an envelope of said high melting metal element having an envelope thickness within the range of 0.05 mm to 1.0 mm.

14. The method of claim 13, wherein said envelope thickness is within the range of 0.1 to 0.5 mm.

15. The method of claim 1, wherein said step (e) is performed in an argon atmosphere at a pressure within the range of 100 MPa to 300 MPa.

16. The method of claim 1, wherein the difference between the melting temperature of said low melting metal element and said high melting metal element is more than 250° C.

17. The method of claim 1, wherein said reaction temperature is at least more than 500° C.

* * * * *